US008408309B2

(12) United States Patent
Eppinghaus et al.

(10) Patent No.: US 8,408,309 B2
(45) Date of Patent: Apr. 2, 2013

(54) RUNNING TOOL

(75) Inventors: Guilherme Eppinghaus, Rio de Janeiro (BR); Nicholas P. Gette, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 342 days.

(21) Appl. No.: 12/856,462

(22) Filed: Aug. 13, 2010

(65) Prior Publication Data

US 2012/0037382 A1 Feb. 16, 2012

(51) Int. Cl.
*E21B 33/04* (2006.01)

(52) U.S. Cl. ..... 166/348; 166/383

(58) Field of Classification Search ..... 166/348.383, 166/383, 208, 212
See application file for complete search history.

(56) References Cited

U.S. PATENT DOCUMENTS

| | | | | |
|---|---|---|---|---|
| 4,969,516 | A | 11/1990 | Henderson et al. | |
| 6,516,876 | B1 | 2/2003 | Jennings | |
| 6,719,044 | B2 | 4/2004 | Ford et al. | |
| 6,823,938 | B1 | 11/2004 | Milberger | |
| 6,848,511 | B1 | 2/2005 | Jones et al. | |
| 7,073,591 | B2 | 7/2006 | Massie et al. | |
| 7,121,344 | B2 * | 10/2006 | Fenton et al. | 166/339 |
| 7,231,970 | B2 | 6/2007 | Matusek et al. | |
| 7,407,011 | B2 | 8/2008 | Kent | |
| 7,909,107 | B2 * | 3/2011 | Gette | 166/382 |
| 2006/0191680 | A1 | 8/2006 | Nelson | |
| 2010/0326664 | A1 * | 12/2010 | Neto et al. | 166/336 |
| 2011/0240306 | A1 * | 10/2011 | Neto | 166/348 |

FOREIGN PATENT DOCUMENTS

EP 2282000 A2 2/2011

OTHER PUBLICATIONS

U.S. Appl. No. 12/416,780, filed Apr. 1, 2009.
U.S. Appl. No. 12/490,874, filed Jun. 24, 2009.
GB Search Report dated Oct. 3. 2011 issued in connection with Application No. GB1113069.7.

* cited by examiner

*Primary Examiner* — William P Neuder
(74) *Attorney, Agent, or Firm* — Bracewell & Giuliani LLP

(57) ABSTRACT

An embodiment of a running tool for setting and testing a packoff seal of a well pipe hanger has an elongated stem having an axial passage, a body, a cam, a cam tail, a stem engagement element, and a piston. A method of setting and testing a packoff seal comprises rotating the stem relative to the body to a delivery position, thereby disengaging the engaging element from the stem. The stem moves axially downward relative to the body to land the packoff. The engagement element reengages the stem in a landing position. Fluid pressure is applied to the axial passage to set and seal the packoff, thereby moving the running tool to a set position.

23 Claims, 13 Drawing Sheets

RUNNING TOOL

FIELD OF THE INVENTION

This technique relates in general to tools for setting and testing well pipe hanger packoff seals in subsea wells, and in particular to a running tool with an internal test feature that prevents the setting of a packoff seal in an incorrect position.

BACKGROUND OF THE INVENTION

A subsea well of the type concerned herein will have a wellhead supported on the subsea floor. One or more strings of casing will be lowered into the wellhead from the surface, each supported on a casing hanger. The casing hanger is a tubular member that is secured to the threaded upper end of the string of casing. The casing hanger lands on a landing shoulder in the wellhead, or on a previously installed casing hanger having larger diameter casing. Cement is pumped down the string of casing to flow back up the annulus around the string of casing. Afterward, a packoff is positioned between the wellhead bore and an upper portion of the casing hanger. This seals the casing hanger annulus.

Casing hanger running tools perform many functions such as running and landing casing strings, cementing strings into place, and delivering, installing, and testing packoffs. A packoff seal is often delivered to a landing position by a drop or longitudinal downward movement of the stem of a running tool. However, if the stem does not travel a sufficient distance to properly land the packoff seal, the seal may be set in an incorrect position. The consequence of an improperly set packoff seal may result in a running tool becoming stuck in a hanger, or alternatively, may require several trips to retrieve the seal, clean the area, and set another seal. Furthermore, if the running tool piston does not stroke the packoff seal sufficiently once landed, the packoff seal will not properly set.

A need exists for a technique that ensures that a packoff seal is landed in a correct position and that the packoff seal is fully set by the stroke of the piston. The following technique may solve one or more of these problems.

SUMMARY OF THE INVENTION

In an embodiment of the present technique, a running tool for setting and testing a packoff seal of a well pipe hanger has an elongated stem having an axial passage. A body substantially surrounds and is connected to the stem. A cam is positioned between and connected to the body and the stem such that rotation of the stem causes the cam to translate axially relative to the body. A cam tail is connected to the cam such that it translates in unison with the cam. A stem engagement element is carried by the body and is adapted to be engaged with the stem at a run-in position and a landing position to restrict axial translation of the stem elative to the body. The cam tail acts to maintain the engagement of the engagement element with the stem in the run-in position, and to release the engagement element from engagement with the stem in a delivery position. A piston is connected to the stem such that the piston and the stem rotate in unison. The piston substantially surrounds portions of the stem and the body.

In an embodiment of the present technique, a running tool for setting and testing an annular seal having an energizing ring in a subsea well has a member adapted to position the annular seal within the subsea well. A piston is adapted to drive the energizing ring to set the annular seal in the subsea well. An engagement system is adapted to provide an indication as to whether the member has delivered the annular seal to a correct location in the subsea well, thereby ensuring that the annular seal is set in a proper location within the subsea well.

In an embodiment of the present technique, a method of setting and testing a packoff seal of a well pipe hanger includes providing a running tool with an elongated stem having an axial passage. A body surrounds and is connected to the stem. A cam is positioned between and connected to the body and the stem such that rotation of the stem causes the cam to translate axially relative to the body. A cam tail is connected to the cam such that it translates in unison with the cam. A stem engagement element is initially engaged with the stem and is maintained in engagement with the stem by the cam tail. A piston substantially surrounds portions of the stem and the body and is downwardly moveable relative to the stem. The running tool is lowered into a subsea wellhead. The stem is rotated relative to the body to a delivery position, thereby removing the support of the cam tail and disengaging the engaging element from the stem. The stem moves axially downward relative to the body to land the packoff. The stem engagement element is reengaged with the stem in a landing position. While in the landing position, fluid pressure is applied to the axial passage of the stem to cause the packoff to set and seal, thereby moving the running tool to a set position.

DETAILED DESCRIPTION OF THE INVENTION

Figure 1A:
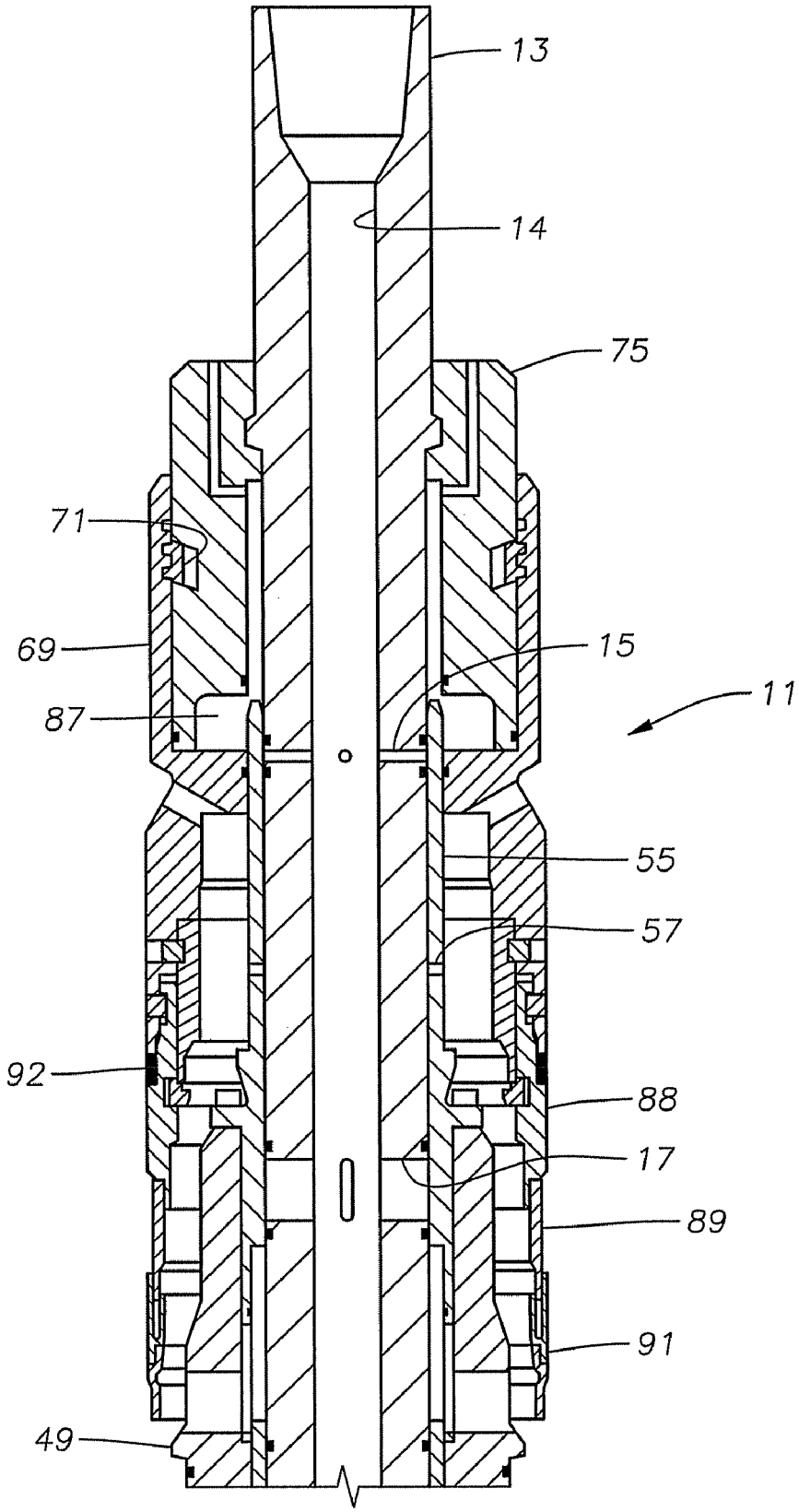
FIG. 1 is a sectional view of a running tool constructed in accordance with the present technique.
Figure 1B:
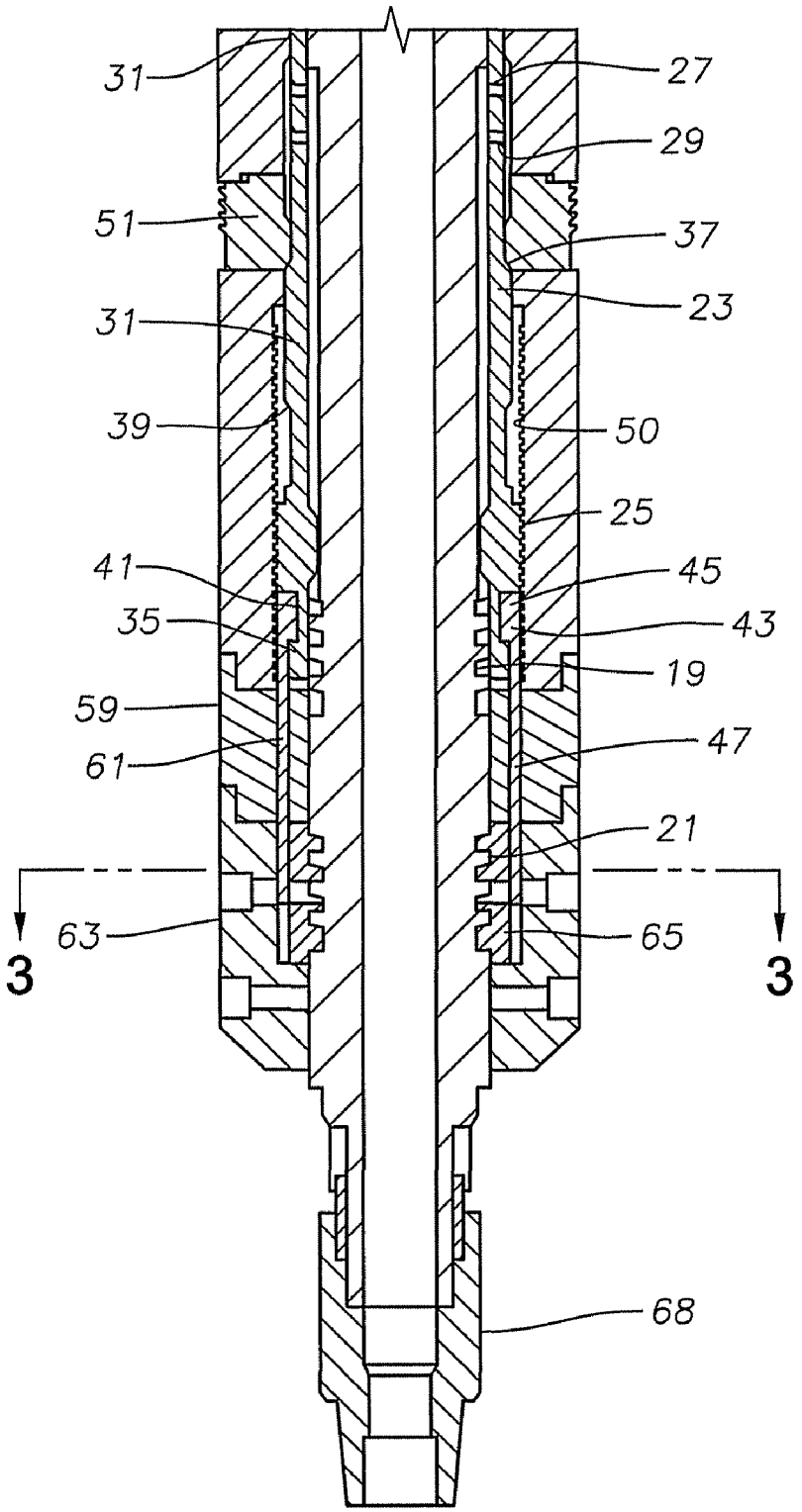

Referring to FIG. 1, there is generally shown an embodiment of a running tool 11 that is used to set and internally test a casing hanger packoff. In this embodiment, the running tool 11 is a two-port casing hanger running tool. The running tool 11 is comprised of a stem 13. In this embodiment, the stem 13 is a tubular member with an axial passage 14 extending therethrough. The stem 13 connects on its upper end to a sting of drill pipe (not shown). The stem 13 has an upper stem port 15 and a lower stem port 17 positioned in and extending radially therethrough that allow fluid communication between the exterior of the running tool 11 and the axial passage 14 of the stem 13. The stem 13 has an upper contoured surface 19 and a lower contoured surface 21 located in the outer diameter of the stem 13 a distance below the lower stem port 17. The upper contoured surface 19 is spaced apart from the lower contoured surface 21 a specified amount.

A cam 23 is a sleeve connected to and substantially surrounding the stem 13. In this embodiment, the cam 23 has axially extending slots (not shown) along portions of its inner diameter. Spring supported anti-rotation keys (not shown) extend radially from an outer diameter portion of the stem 13 and are captured in the axially extending slots (not shown) on the inner diameter portions of the cam 23, such that the stem 13 and the cam 23 rotate in unison. The axially extending slots (not shown) allow the cam 23 to move axially relative to the stem 13. Portions of the outer diameter of the cam 23 have threads 25 contained therein. The cam 23 has an upper cam port 27 and a lower cam port 29 positioned in and extending radially therethrough that allow fluid communication between the exterior and interior of the cam 23. The cam 23 has an upper cam portion 31, a medial cam portion 33, and a lower cam portion 35. The cam ports 27, 29 are located in the upper cam portion 31 of the cam 23. The medial cam portion 33 has a generally uniform outer diameter that is greater than the outer diameter of the upper cam portion 31, thereby forming an upwardly facing annular shoulder 37 on the outer surface of the cam 23. As the medial cam portion 33 transitions to the lower cam portion 35, the outer diameter of the cam 23 decreases to substantially the same outer diameter of the upper cam portion 31, thereby forming a downwardly facing annular shoulder 39. A recessed pocket 41 is positioned in the outer surface of the cam 23 at a select distance below the downwardly facing shoulder 39.

Figure 2:
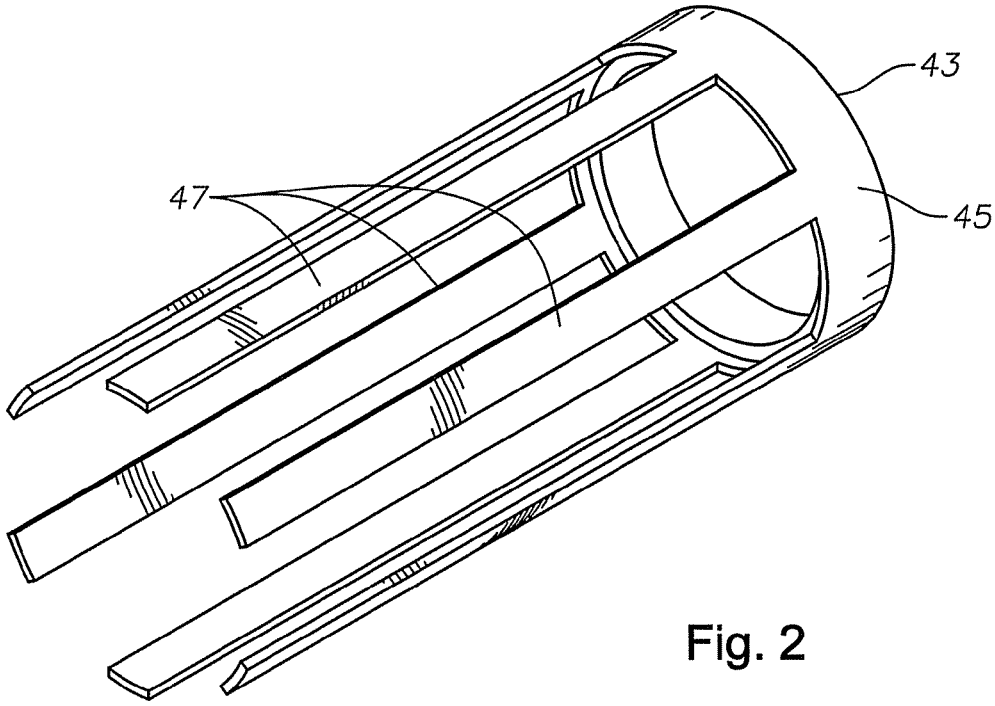
FIG. 2 is a perspective view of a cam tail constructed in accordance with the present technique.

A cam tail 43 is a sleeve like member connected to the lower cam portion 35 of the cam 23. The cam tail 43 has a flange like upper portion 45 that rides in the pocket 41 on the outer diameter of the lower cam portion 35 of the cam 23. The cam tail 43 and the cam 23 are connected to one another such that the cam tail 43 and cam 23 move axially in unison, but the cam 23 rotates relative to the cam tail 43. As illustrated in FIG. 2, the cam tail 43 has a plurality of tails 47 that extend axially downward from the flange portion 45 of the cam tail 43 at select intervals around the perimeter of the cam tail 43.

Referring back to FIG. 1, a main body 49 substantially surrounds portions of the cam 23, the cam tail 43, and the tool stem 13. In this embodiment, the main body 49 has threads 50 along portions of its inner diameter that threadably engage the threads 25 on portions of the outer diameter of the cam 23, such that the cam 23 can rotate relative to the body 49. A medial portion of the main body 49 houses an engaging element 51. In this particular embodiment, the engaging element 51 is a plurality of dogs, each having a smooth inner surface and a contoured outer surface. The contoured outer surface of each engaging element 51 is adapted to engage a complimentary contoured surface on the inner surface of a casing hanger 53 (FIG. 5) when the engagement element 51 is engaged with the casing hanger 53. The inner surface of the engaging element 51 is initially in contact with an outer surface portion of the cam 23.

An upper body 55 is connected to an upper portion of the main body 49. The main body 49 and the upper body 55 act as an integral body, moving in unison. The upper body 55 has a port 57 extending radially therethrough that allows fluid communication between the interior and exterior of the upper body 55. A lower body 59 is connected to a lower portion of the main body 49. The main body 49 and the lower body 59 act as an integral body, moving in unison. The tail portions 47 of the cam tail 43 extend axially through slots 61 that extend axially through the lower body 59. A bearing cap 63 is securely connected to a lower portion of the lower body 59 and substantially surrounds portions of the cam tail 43 and the stem 13. The bearing cap 63 is an integral part of the main body 49 and the lower body 59 and as such, the stem 13 also rotates relative to the bearing cap 63. An engaging element 65 is positioned along the inner diameter of the bearing cap 63. In this particular embodiment, the engaging element 65 is a plurality of stem locking dogs, each having a contoured inner surface and a smooth outer surface. The contoured inner surface of each engaging element 65 is adapted to engage the complimentary contoured surfaces 19, 21 on the outer surface of the stem 13 (FIG. 1, FIG. 9) when the engagement element 65 is engaged with the stem 13. In this embodiment, the downward facing surfaces of the contoured surfaces 19, 21 and the corresponding surfaces of the stem locking dogs 65 have a tapered shape so that when engaged, downward motion of the stem 13 relative to the stem locking dogs 65 produces a force to urge the stem locking dogs 65 outward. Conversely, the upward facing surfaces of the contoured surfaces 19, 21 and the corresponding surfaces of the stem locking dogs 65 have a generally flat shape in this embodiment so that when engaged, an upward motion of the stem 13 relative to the stem locking dogs 65 will be opposed by the stem locking dogs 65. The contoured outer surface of the engaging element 65 is initially in engagement with the complimentary lower contoured surface 21 on the stem 13.

Figure 3:
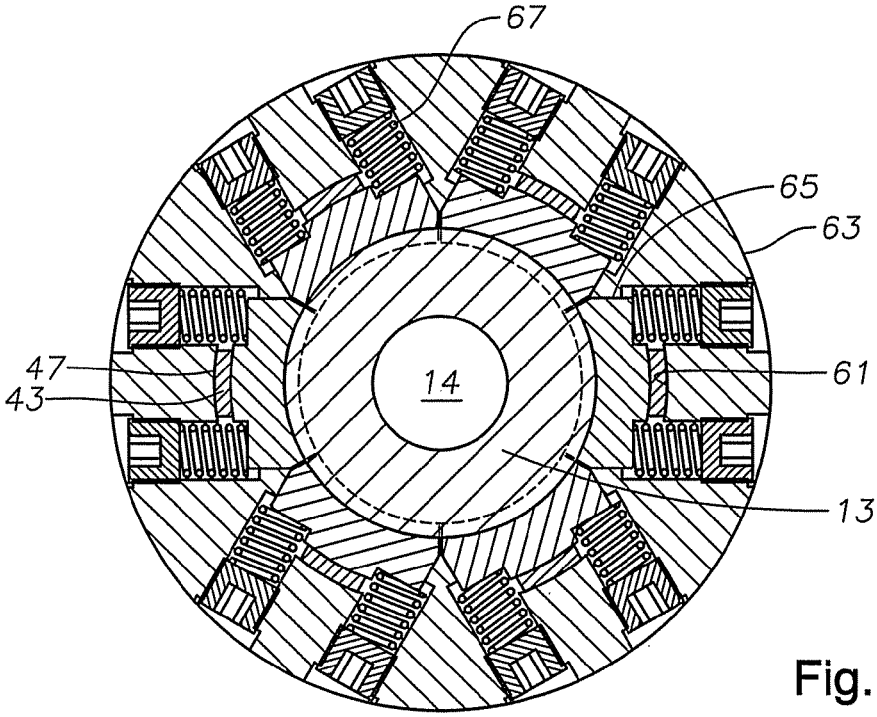
FIG. 3 is sectional view of the running tool taken along the line 3-3 of FIG. 1.

As illustrated in FIG. 3, a resilient member 67, in this embodiment, springs, is positioned between the engaging element 65 and the inner diameter of bearing cap 61 and act to bias the engaging element 65 radially inward. The tail portions 47 of the cam tail 43 are initially positioned between the stem lock dogs 65 and the inner diameter of the bearing cap 35 such that the outer surfaces of the stem lock dogs 65 are initially in contact with inner surface portions of the tail portions 47 of the cam tail 43. In this initial position, the tail portions 47 of the cam tail 43 prevent the lock dogs 65 from moving radially outward due to the force applied by the stem 13, thus maintaining the engagement of the inner contoured surface of the engaging element 65 with the lower contoured surface 21 of the stem 13 (FIG. 1).

Referring back to FIG. 1, a dart landing sub 68 is connected to the lower end of stem 13. The landing sub 68 will act as a landing point for an object, such as a dart, that will be lowered into the stem 13. When the object or dart lands within the landing sub 68, it will act as a seal, effectively sealing the lower end of the stem 13.

The main body 49, the upper body 55, the lower body 59, and the bearing cap 63 are integrally connected to one another such that they move in unison. The main body 49, the cam 23, and the stem 13 are connected in such a manner that rotation of the stem 13 in a first direction relative to the main body 49 causes the cam 23 to rotate in unison and simultaneously move axially upward relative to the main body 49. The cam tail 43 is connected to the cam 23 in such a manner that rotation of the stem 13 in a first direction relative to the body 31 causes the cam tail 43 to move axially upward relative to the main body 49 in unison with the cam 23. However, the cam 23 rotates relative to the cam tail 43.

A piston 69 surrounds the stem 13 and substantial portions of the upper body 55 and the main body 49. The piston 69 is connected to the stem 13 by way of a piston lock ring 71. The piston lock ring 71 is positioned in an annular recess 73 on an outer surface portion of a piston cap 75. The piston lock ring 71 has a contoured outer surface and a smooth inner surface. The piston lock ring 71 is biased outwardly, and is initially in contact with a complimentary contoured surface on an inner surface portion of the piston 69.

Figure 4:
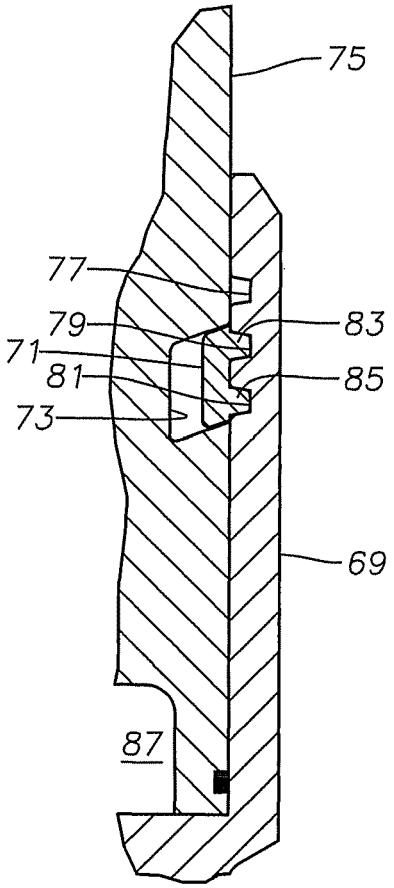
FIG. 4 is an isolated and enlarged view of the piston lock ring of the running tool of FIG. 1.

Referring to FIG. 4, in this embodiment, the contoured inner surface of the piston 69 comprises three grooves 77, 79, 81. In this embodiment, the contoured outer surface of the piston lock ring 71 comprises two annular bands 83, 85. Each annular band 83, 85 is geometrically complimentary to each groove 77, 79, 81. Initially, the annular bands 83, 85 of the piston lock ring 71 are engaged with the grooves 79, 81 on the inner surface of the piston 69.

Referring back to FIG. 1, the piston 69 is connected to the stem 13 such that it rotates in unison with the stem 13 and is also capable of movement axially relative to the stem 13. A piston cavity or chamber 87 is located between a portion of the piston 69 and the piston cap 75. A setting sleeve 88 is connected to the lower portion of the piston 69. The setting sleeve 88 carries an energizing ring 89 of a casing hanger packoff seal 91 along its lower end. This enables the setting sleeve 88 to position the packoff seal 91 and then set the packoff seal 91 by driving the energizing ring 89 downward. A bulk rubber seal 92 is positioned in an annular recess along the outer diameter of the piston 69, just above the setting sleeve 88. The packoff seal 91 will act to seal the casing hanger 53 to a subsea wellhead housing 93 (FIG. 6) when properly set. In operation, the piston 69 is initially in a "cocked" position, and the stem ports 15, 17, the cam ports 27, 29, and the upper body port 57 are offset from one another as shown in FIG. 1.

Figure 5:
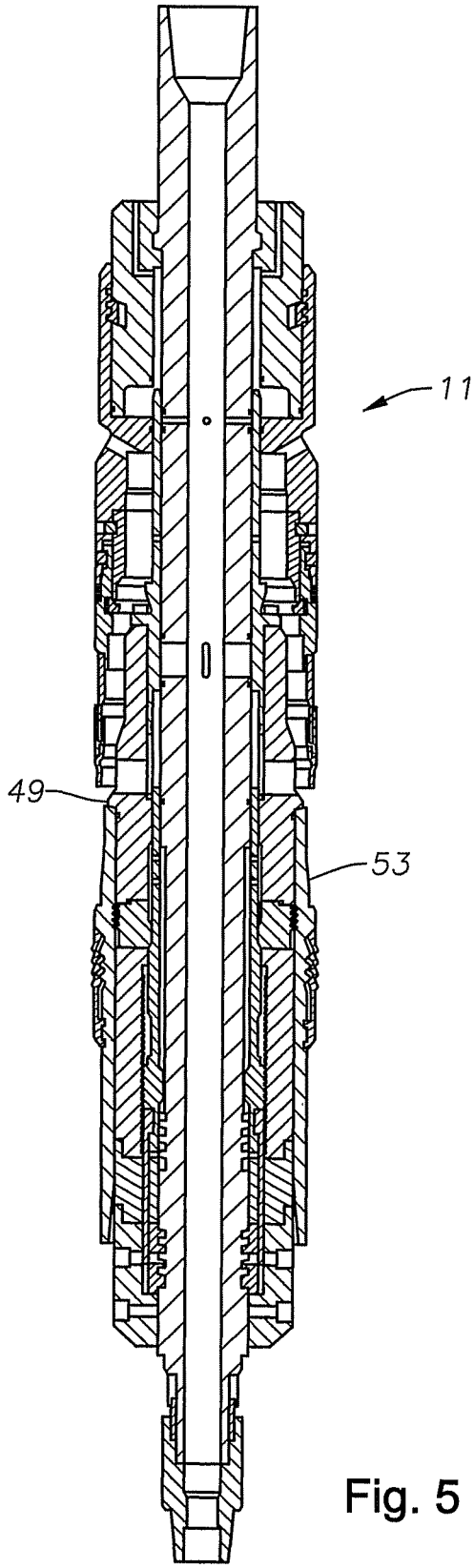
FIG. 5 is a sectional view of the running tool inserted into a casing hanger and in a run-in position.

As illustrated in FIG. 5, the running tool 11 is lowered into the casing hanger 53 until a shoulder on the outer surface of the main body 49 of the running tool 11 contacts an upper end surface of the casing hanger 53. The casing hanger 53 will be secured to a string of casing that is supported by slips at the rig floor.

Figure 6:
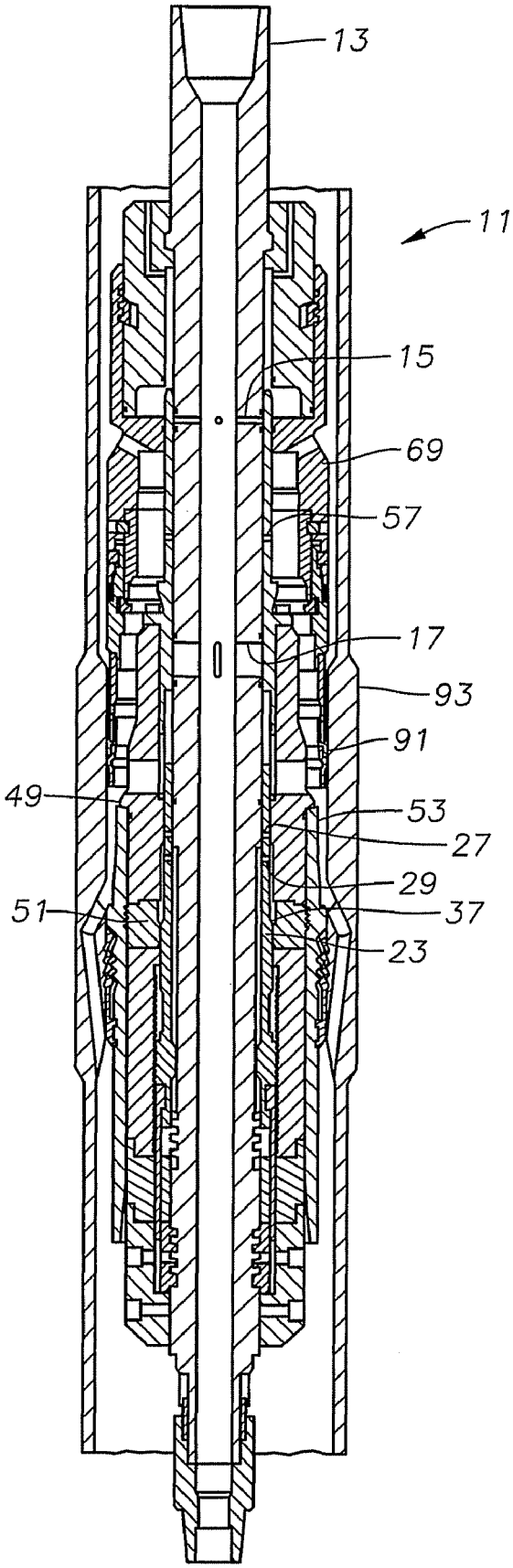
FIG. 6 is a sectional view of the running tool engaged with the casing hanger and inserted into a wellhead housing.

As illustrated in FIG. 6, once the main body 49 of the running tool 11 and the casing hanger 53 are in abutting contact with one another, the stem 13 is rotated a specified number of revolutions relative to the main body 49. As the stem 13 is rotated relative to the main body 49, the cam 23 moves longitudinally upward relative the main body 49. As the cam 23 moves longitudinally upward, the upwardly facing shoulder 37 on the outer surface of the cam 23 makes contact with the engaging element 51, forcing it radially outward and into engaging contact with a profile or recess in the inner surface of the casing hanger 53, thereby locking the main body 49 to the casing hanger 53. As the cam 23 moves longitudinally upward, the stem ports 15, 17, the cam ports 27, 29, and the upper body port 57 also move relative to one another.

Figure 7:
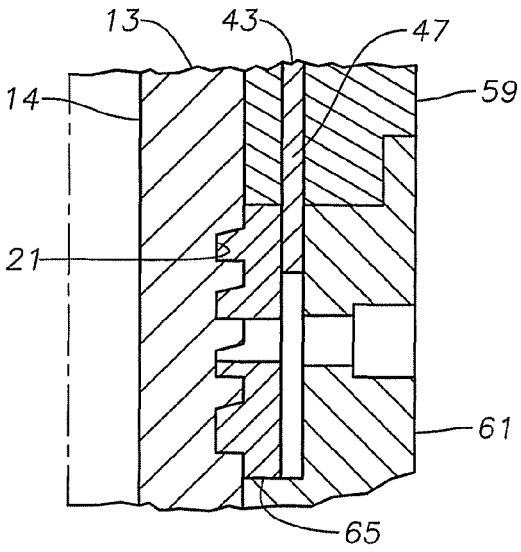
FIG. 7 is an isolated and enlarged view of the stem locking dogs of the running tool of FIG. 6.

As illustrated in FIG. 7, as the cam 23 moves longitudinally upward, the cam tail 43 and the tail portions 47 move upward relative to the stem locking dogs 65. However, in this run-in position of the running tool 11, the tail portions 47 of the cam tail 43 still support a portion of the locking dogs 65, thereby maintaining the engagement of the stem locking dogs 65 with the contoured surface 21 of the stem 13.

Once the running tool 11 and the casing hanger 53 are locked to one another, the running tool 11 and the casing hanger 53 are lowered down the riser (not shown) until the casing hanger 53 comes to rest in the subsea wellhead housing 93. The operator then pumps cement down the string, through the casing, and back up an annulus surrounding the casing.

Figure 8:
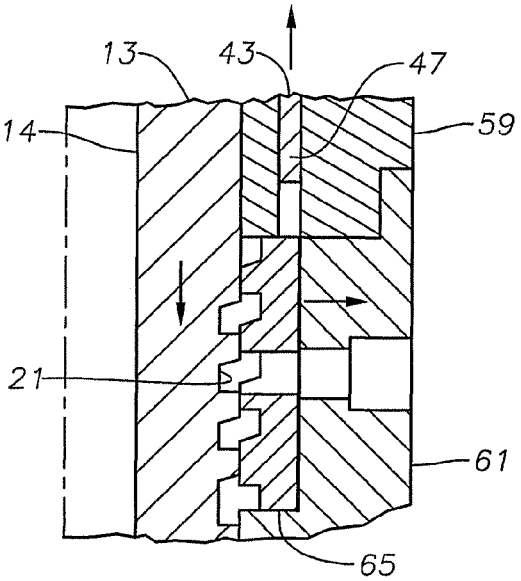
FIG. 8 is an isolated and enlarged view of the stem locking dogs of the running tool.

As illustrated in FIG. 8, the stem 13 is then rotated a specified number of additional revolutions in the same direction as before. As the stem 13 is rotated relative to the main body 49, the cam 23 moves further longitudinally upward relative to the main body 49. As the cam 23 moves further longitudinally upward, the cam tail 43 and the tail portions 47 move upward relative to the stem locking dogs 65. As the cam tail 43 moves longitudinally upward, the tail portions 47 of the cam tail 43 move out of contact with the stem locking dogs 65. The contoured surface 21 of the stem 13 and the surface of the stem locking dogs 65 are tapered so that a downward motion of the stem 13 relative to the stem locking dogs 65 causes the contoured surface 21 to urge the stem locking dogs 65 outward. Here, the weight of the stem 13 and the forces that it exerts on the locking dogs 65 through the engagement of the contoured surface 21 and the stem locking dogs 65 exceeds the force of the springs 67 (FIG. 3) acting on the locking dogs 65 to maintain them in engagement with the contoured surface 21 of the stem 13. As a result, the forces on the stem locking dogs 65 move them radially outwards, thereby disengaging the stem 13. The stem 13 is then free to drop and moves longitudinally downward relative to the main body 49, in a delivery position.

Figure 9:
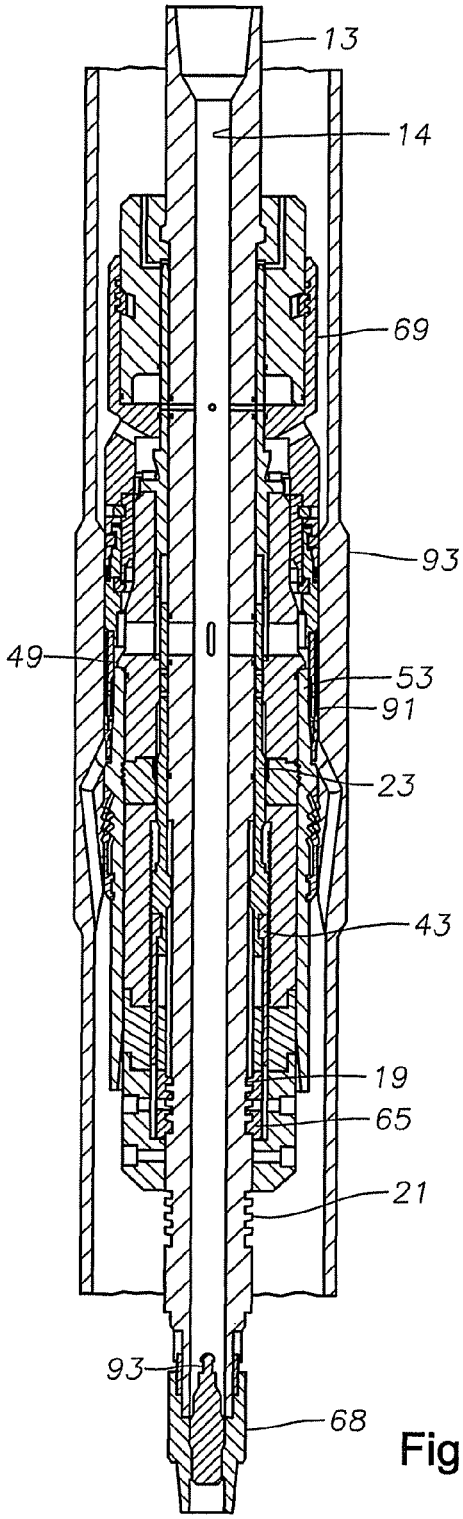
FIG. 9 is a sectional view of the running tool in a landing position.

Referring to FIG. 9, as the stem 13 moves longitudinally downward relative to the main body 49, the piston 69, the setting sleeve 88, and the packoff seal 91 also move downward relative to the body. The stem 13 moves longitudinally downward relative to the main body 49 until the packoff seal 91 makes contact with either the casing hanger 53 or debris sitting on the casing hanger shoulder. If the piston 69 and the stem 13 traveled sufficiently downward to deliver the packoff seal 91 to the casing hanger 53, the stem lock dogs 65 will re-engage the contoured surface 19 of the stem 13. This is referred to as the landing position of the running tool 11. As will be discussed in more detail below, if the stem lock dogs 65 re-engage the stem 13, then the stem lock dogs 65 will enable the stem 13 to act as a reaction point for hydraulic pressure applied to the piston 69 to set the packoff seal 91. However, if the stem lock dogs 65 do not re-engage the stem 13, then hydraulic pressure applied to drive the piston 69 downward to set the packoff seal 91 will urge the stem 13 to lift and insufficient pressure will be created to drive the piston 69 downward to set the seal 91.

The operator can apply tension to the stem 13 to determine if the stem 13 has traveled a sufficient distance to deliver the packoff seal 91 to the casing hanger 53 and re-engaged the stem lock dogs 65 to the stem 13. The contoured surfaces 19, 21 of the stem 13 and the stem locking dogs 65 are configured so that when the stem 13 and stem locking digs 65 are engaged, an upward motion of the stem 13 relative to the stem locking dogs 65 will be opposed by the stem locking dogs 65. If the stem 13 moves more than a limited distance longitudinally upward relative to the main body 49 when the tension is applied, then this is an indication that the stem locking dogs 65 have not engaged the contoured surface 19 of the stem 13, and also an indication that the stem 13 did not travel a sufficient distance to deliver the packoff seal 91 to the casing hanger 53. In this instance, the operator can reciprocate the landing string up and down until the packoff seal 91 pushes enough debris out of the way to allow the contoured surface 19 of the stem 13 to be engaged by the stem locking dogs 65. However, if the stem 13 does not travel longitudinally upward, or travels only a limited distance relative to the main body 49, then this is a positive indication that the stem locking dogs 65 have engaged the contoured surface 19 of the stem 13, and that the stem 13 did travel a sufficient distance to deliver the packoff seal 91 to the casing hanger 53.

Figure 10:
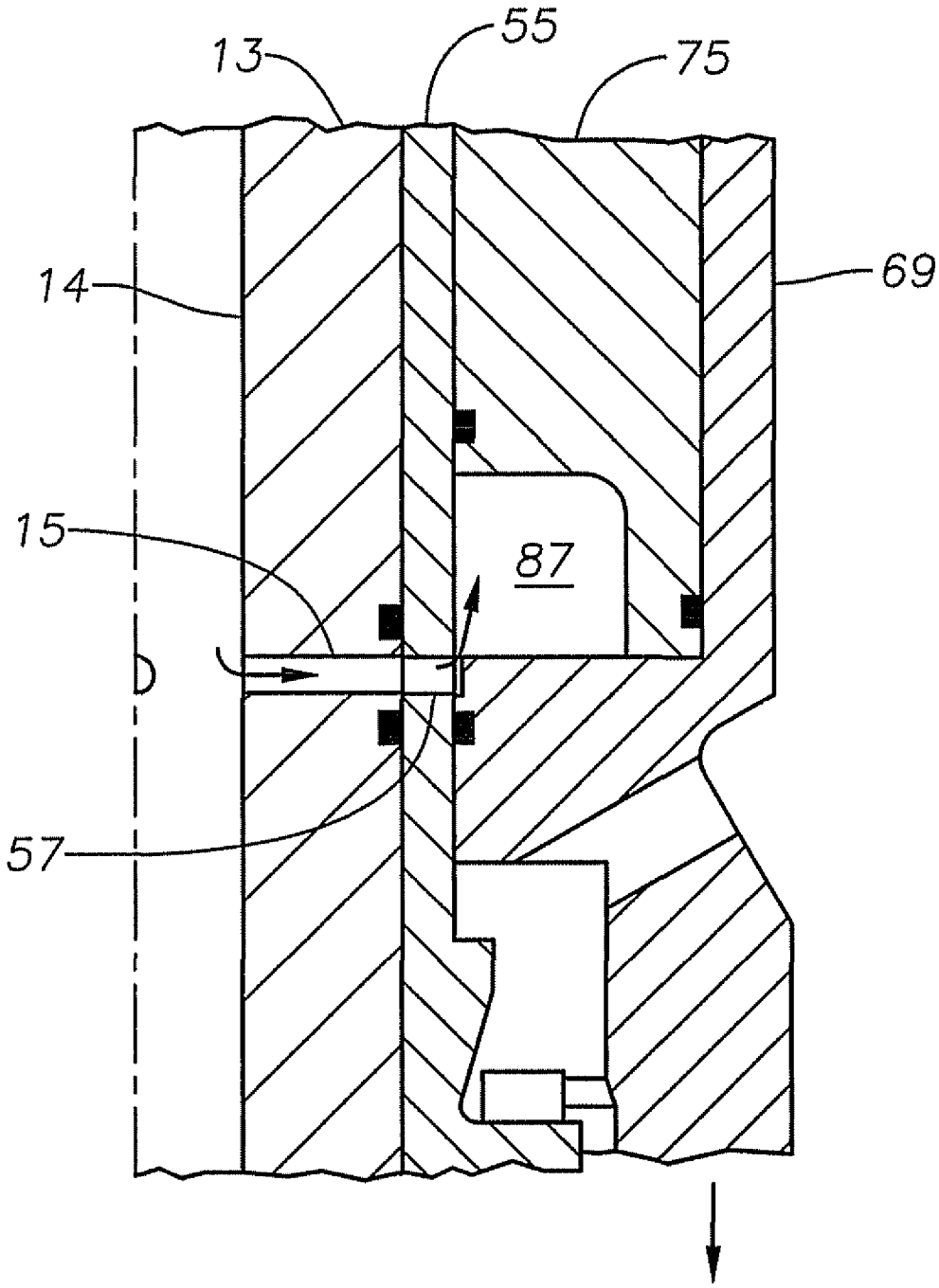
FIG. 10 is an isolated and enlarged view of a portion of the piston of the running tool of FIG. 9.

In addition, as illustrated in FIG. 10, if the stem 13 has traveled the appropriate distance, the upper stem port 15 of the stem 13 will be aligned with the upper body port 57 of the upper body 55, thereby enabling fluid communication between the axial passage 14 of the stem 13 and the piston cavity 87. As will be discussed in more detail below, if the stem locking dogs 65 are re-engaged with the stem 13 and sufficient hydraulic pressure is applied to the piston cavity 87, the piston 69 and the setting sleeve 88 will be driven downward to set the seal 91.

Figure 11:
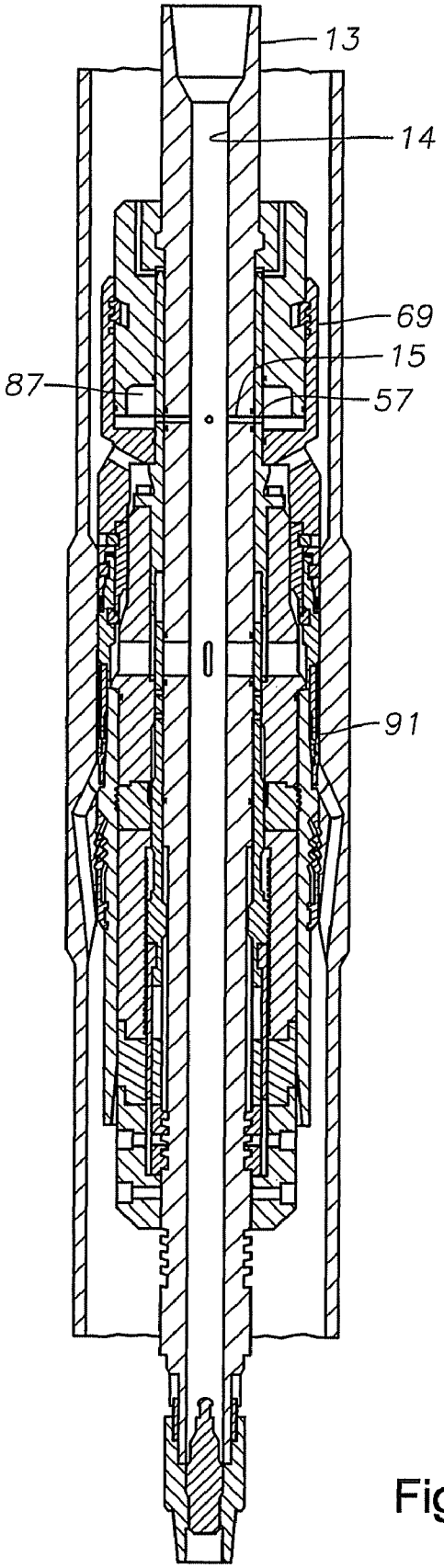
FIG. 11 is a sectional view of the running tool in a set position.

Referring to FIG. 11, in order to set the packoff seal 91 between the wellhead housing 93 and the casing hanger 53, the axial passage 14 of the stem must be sealed. A solid dart 93 is then dropped or lowered into the axial passage 14 of the stem 13. The solid dart 93 lands in the landing sub 68, thereby sealing the lower end of the stem 13.

Figure 12:
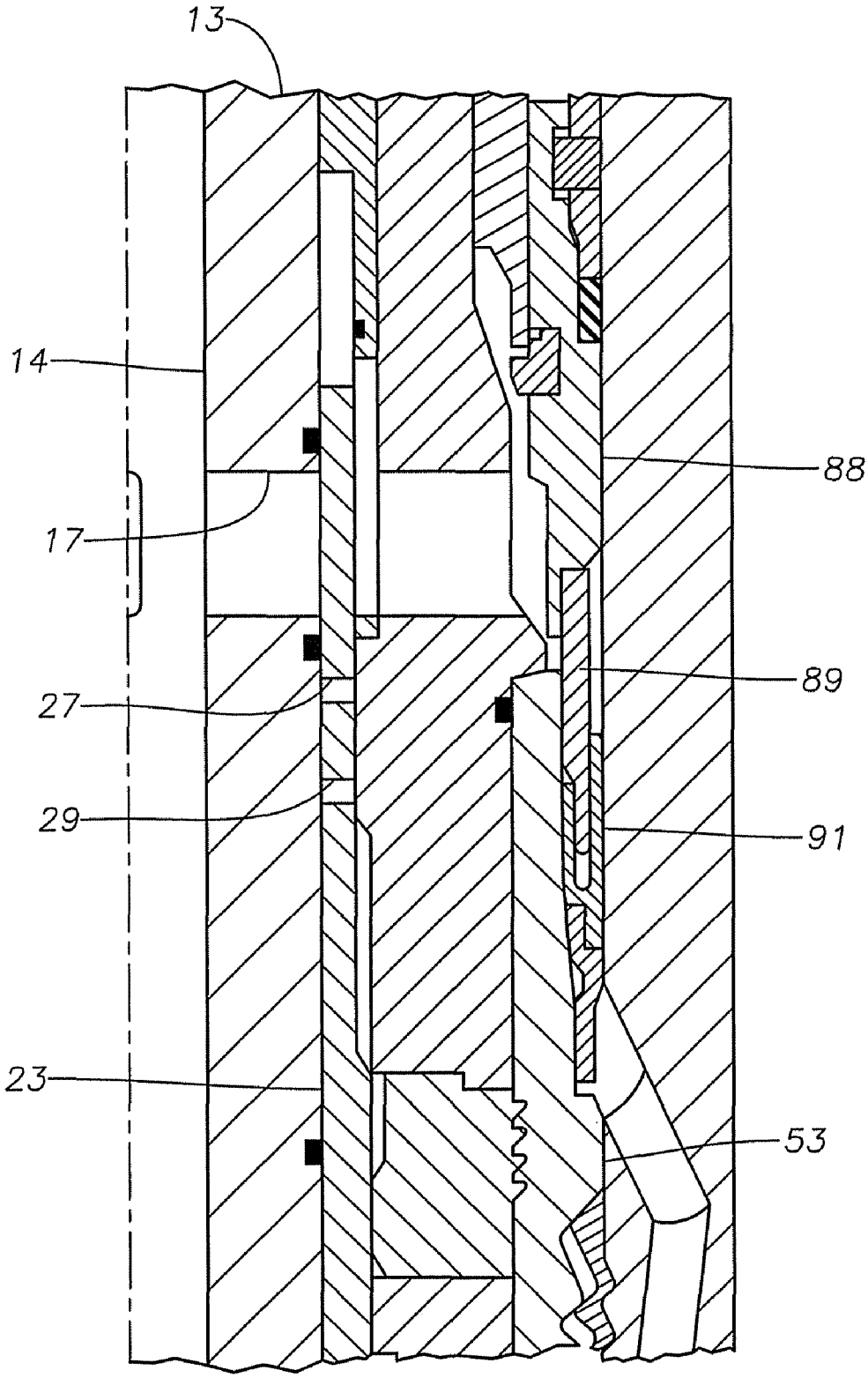
FIG. 12 is an isolated and enlarged view of a portion of the cam of the running tool of FIG. 11.

Referring to FIGS. 10-12, fluid pressure is then applied down the drill pipe and travels through the axial passage 14 of stem 13 before passing through the upper stem port 17, the upper body port 57, and into the chamber 87 of the piston 69, driving it downward relative to the stem 13 and setting the packoff seal 91. This is referred to as the running tool 11 set position and is shown in FIGS. 11 and 12.

If the packoff seal 91 is not delivered to the proper position, i.e., the stem 13 has not dropped a sufficient distance to deliver the packoff seal 91 to the desired position relative to the casing hanger 53, the running tool 11 will prevent the packoff seal 91 from being set. As previously discussed, if the stem locking dogs 65 have not engaged the contoured surface 19 of the stem 13, when pressure is applied down the drill pipe, the buildup of pressure in the piston cavity 87 will produce a force to drive the stem 13 to move longitudinally upward relative to the main body 49 of the running tool 11. An insufficient pressure will be applied to the piston 69 to overcome the force required to set the packoff seal 91. Additionally, the upper stem port 15 may not be aligned with the upper body port 57, thereby preventing fluid pressure from entering the piston cavity 87 at all. As a result, the piston 69 and the setting sleeve 88 will not be driven downward relative to the stem 13.

However, if the packoff seal 91 is delivered to the proper position, i.e., the stem 13 has dropped sufficient distance to deliver the packoff seal 91 to the desired position relative to the casing hanger 53, the stem locking dogs 65 will re-engage the stem 13 and the stem 13 will be secured to the main body 49 of the running tool 11. When pressure is applied down the drill pipe, the upper stem port 15 will be aligned with the upper body port 57 and the pressure in the piston cavity 87 will react against the piston cap 75 to urge the piston 69 and the setting sleeve 88 downward to set the packoff seal 91. A lifting force on the piston cap 75 will be transmitted to the stem 13. However, because the contoured surface 19 of the stem 13 and the stem locking dogs 65 are configured such that the stem locking dogs 65 oppose upward motion of the stem 13, the pressure in the piston cavity 87 is directed to urge the piston 69 downward.

Figure 13:
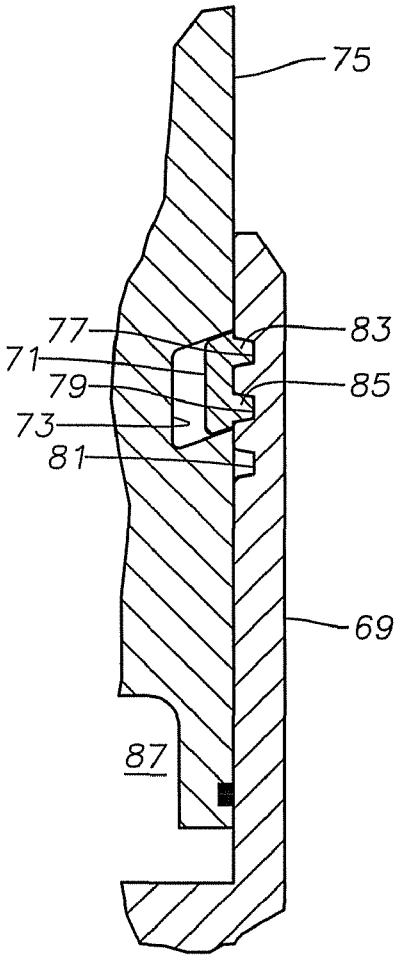
FIG. 13 is an isolated and enlarged view of the piston lock ring of the running tool of FIG. 11.

As illustrated by FIG. 13, if the packoff seal 91 was properly delivered to the casing hanger 53, as the piston 69 moves downward, the force of the piston 69 on the piston lock ring 71 and its bands 83, 85 moves the lock ring 71 radially inward into the annular recess 73 in the piston cap 75. When the piston 69 moves longitudinally downward relative to the stem 13 sufficiently to set the packoff seal 91, the piston lock ring 71 springs radially outward, and the bands 83, 85 engage the grooves 77, 79 on the inner surface of the piston 69. If the piston 69 does not move sufficiently to set the packoff seal 91, the piston lock ring 71 will not spring into engagement with the groove 77, 79 on the inner surface of the piston 69.

Figure 14:
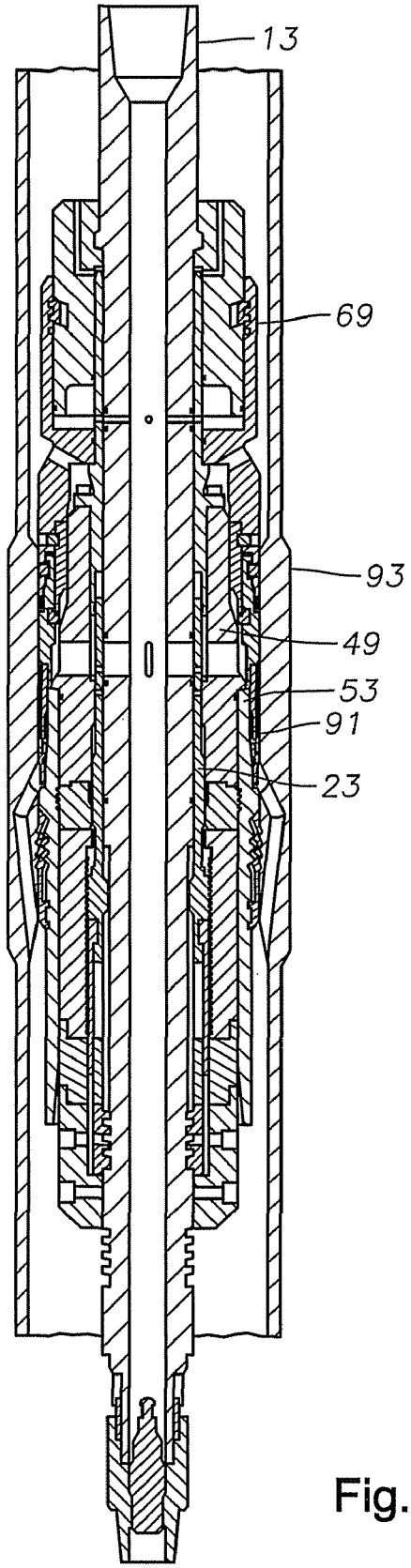
FIG. 14 is a sectional view of the running tool in a test position.

Referring to FIG. 14, once the piston 69 is driven downward and the packoff seal 91 is set between the casing hanger 53 and the wellhead housing 93, the stem 13 is then rotated an additional specified number of revolutions in the same direction as before to prepare the seal 91 for testing to verify that it is set. As the stem 13 is rotated relative to the main body 49, the cam 23 moves further longitudinally upward relative to the main body 49.

Figure 15:
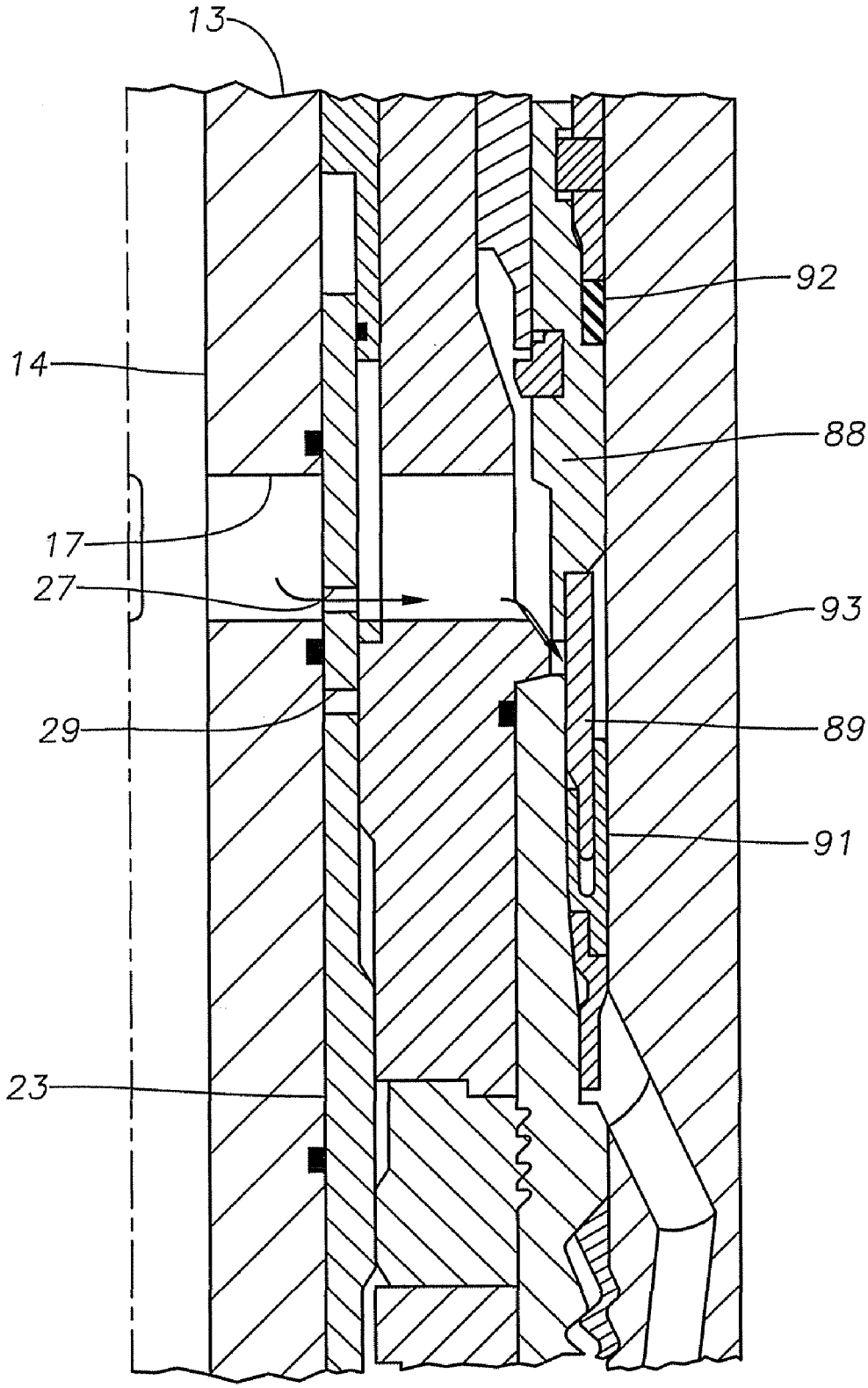
FIG. 15 is an isolated and enlarged view of a portion of the cam of the running tool of FIG. 14.

As illustrated in FIG. 15, as the cam 23 moves, the lower stem port 17 and the cam ports 27, 29 also move relative to one another. The lower stem port 17 aligns with the upper cam port 27, allowing fluid communication from the axial passage 14 of stem 13, through the stem 13, and into and through the upper cam port 27 of the cam 23. Weight is then applied downward on the drill string. This is referred to as the running tool 11 test position.

Referring back to FIG. 13, if the piston 69 has stroked sufficiently to set the packoff seal 91 (FIG. 12), the piston lock ring 71 and the bands 83, 85, will be in engagement with the grooves 77, 79 on the inner surface of the piston 69, allowing the weight down on the stem 13 to be transferred from the stem 13, through the piston lock ring 71, and into the piston 69.

As illustrated in FIG. 15, the weight down on the piston 69 (FIG. 14) will compress the bulk rubber seal 92, thereby engaging the seal 92 with the inner wall of the wellhead housing 93 and forming a seal. As a result, an isolated test volume is formed above the packoff seal 91. Pressure is then applied down the drill pipe and travels through the axial passage 14 of stem 13 before passing through the lower stem port 17, the upper cam port 27, and into the isolated volume above the packoff seal 91, thereby testing the packoff seal 91. If the applied pressure is maintained, then the seal 91 was set correctly. However, if the piston 69 was not stroked sufficiently to set the packoff seal 91, when the weight down is applied to the stem 13, the piston cap 75 will abuttingly contact the upper body 55, thereby preventing the stem 13 and the piston 69 from moving downward sufficiently to compress the bulk rubber seal 92. The piston lock ring 71 will not transfer the weight to the piston 69 and the rubber seal 92 will not compress and engage the inner wall of the wellhead housing 93. As a result, the pressure will not be maintained and the pressure test will fail as the pressure bypasses the bulk rubber seal 92.

Figure 16:
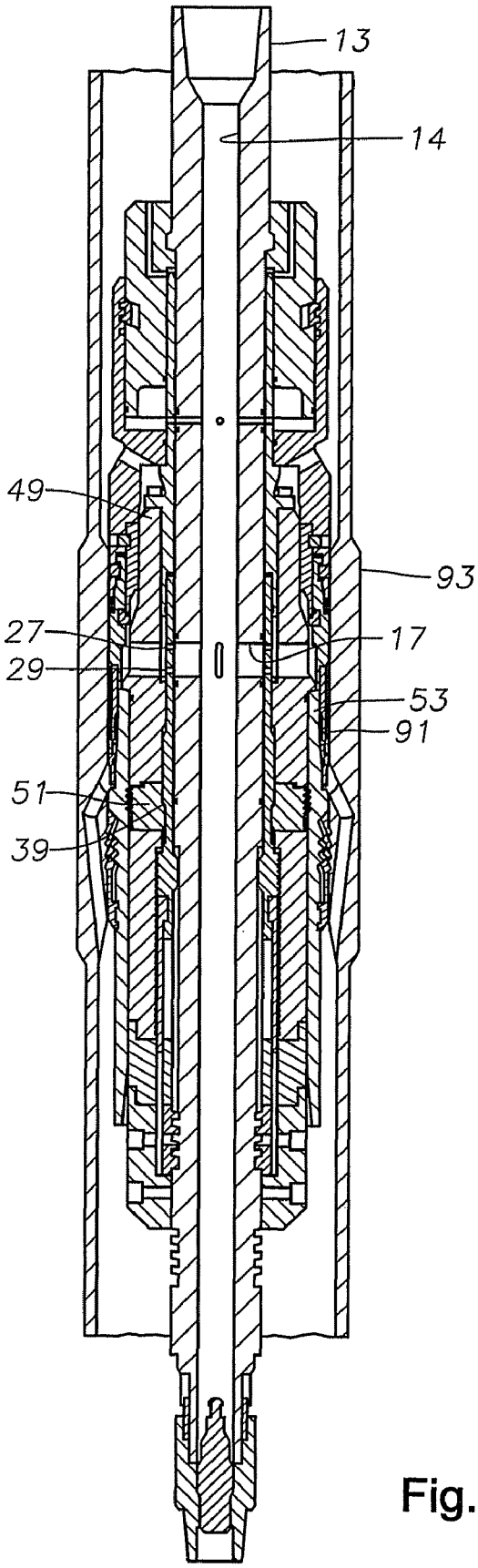
FIG. 16 is a sectional view of the running tool in a run-out position.

Referring to FIG. 16, once the packoff seal 91 has been tested, the stem 13 is then rotated a specified number of additional revolutions in the same direction. As the stem 13 is rotated relative to the main body 49, the cam 23 moves further longitudinally upward relative to the main body 49.

Figure 17:
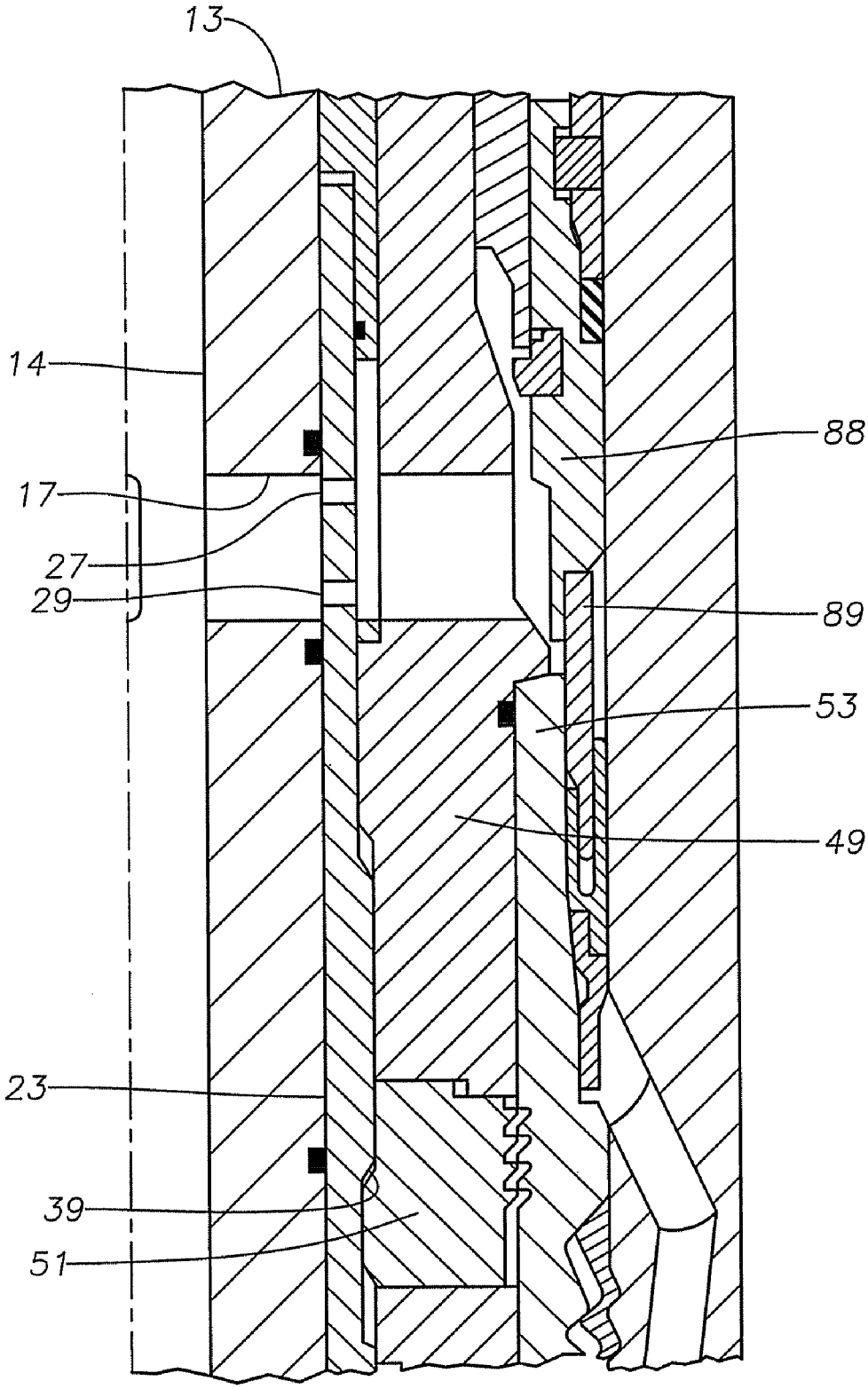
FIG. 17 is an isolated and enlarged view a portion of the cam of the running tool of FIG. 16.

As illustrated in FIG. 17, the downward facing shoulder 39 of the cam 23 passes by the engagement element 51. As a result, the engagement element 51 is freed and moves radially inward, thereby unlocking the main body 49 from the casing hanger 53. The upward movement of the cam 23 relative to the main body 49 also causes the upper 27 and lower 29 cam ports to move relative to the stem 13. As a result, both the upper 27 and the lower 29 cam ports align with the lower stem port 17, thereby allowing fluid communication between the axial passage 14 of the stem 13 and the exterior of the main body 49. The running tool 11 can then be removed from the wellbore, and any fluid remaining in the running tool 11 will travel through the lower stem port 17, into and through the upper 27 and the lower 29 cam ports, and through the main body 49, thereby draining the running tool 11.

The running tool is an effective and efficient technique to ensure that a packoff seal is set in a correct position. The stem locking dogs provide the operator with a positive or negative indication as to whether the packoff seal has been delivered to the correct position. The running tool is also an effective and efficient technique to ensure that a packoff seal has been fully set. The piston lock ring ensures that a pressure test can only be performed if the piston has fully stroked and set the packoff seal, providing an operator with a positive or negative indication as to whether the piston has adequately stroked.

While the invention has been shown in only one of its forms, it should be apparent to those skilled in the art that it is not so limited but is susceptible to various changes without departing from the scope of the invention.

The invention claimed is:

1. A running tool for setting and testing an annular seal having an energizing ring, in an annulus between an inner wellhead member and an outer wellhead member of a well, the running tool comprising:

a seal delivery and setting system adapted to position the annular seal in the annulus between the inner wellhead member and the outer wellhead member and to drive the energizing ring to set the annular seal in the annulus, and wherein the seal delivery and setting system is adapted to prevent the seal delivery and setting system from driving the energizing ring to set the annular seal in the annulus unless the annular seal is located at a desired location in the annulus relative to the inner wellhead member.

2. The running tool of claim 1, wherein the seal delivery and setting system comprises:

an elongated stem having an axial passage; and a piston configured: to drive downward to drive the energizing ring to set the annular seal when pressure is applied to the axial passage in the elongated stem and the annular seal is located at the desired location in the annulus relative to the inner wellhead member; and to not drive downward to drive the energizing ring to set the annular seal when pressure is applied to the axial passage in the elongated stem and the annular seal is not located at the desired location in the annulus relative to the inner wellhead member.

3. The running tool of claim 2, wherein the seal delivery and setting system comprises:

a body substantially surrounding and connected to the stem; and a cam positioned between and connected to the body and the stem such that rotation of the stem causes the cam to translate axially relative to the body, wherein the piston is connected to the stem such that the piston and the stem rotate in unison, the piston substantially surrounding portions of the stem and the body.

4. The running to tool of claim 3, wherein the seal delivery and setting system comprises:

a stem engagement element carried by the both and adapted to be engaged with the stem at a run-in position and a landing position to restrict axial translation of the stem relative to the body, the cam acting to maintain engagement of the engagement element with the stem in the run-in position, and to release the engagement element from engagement with the stem in a delivery position.

5. The running tool of claim 4, wherein the stem engagement element will not engage the stem unless the annular seal is located at a desired location in the annulus relative to the inner wellhead member, thereby allowing the stem to move freely relative to the body if the annular seal is not in the desired location, thus preventing the piston from driving the energizing ring to set the annular seal in the annulus.

6. A running tool for setting and testing an annular seal having an energizing ring in an annulus between an inner wellhead member and an outer wellhead member of a well, the running tool comprising:

an elongated stem having an axial passage;

a body coupled to the stem and adapted to support the inner wellhead member;

a stem engagement element carried by the body and selectively engageable with the stem to restrict axial movement of the stem relative to the body, the stem engagement assembly comprising a cam positioned relative to the body and the stem such that rotation of the stem causes the cam to translate axially relative to the body, wherein the cam enables the engagement element to engage the stem at a first position on the stem, directs the stem engagement element to release the stem to enable the stem to drop downward relative to the body, and then enables the stem engagement element to re-engage the stem at a second position on the stem at a given axial distance from the first position on the stem; and a seal delivery assembly adapted to support an annular seal and to deliver the annual seal to a desired location relative to the inner wellhead member, the seal delivery assembly being coupled to the stem such that the annular seal is moved downward with the stem when the stem is dropped and downward movement of the stem is limited by downward movement of the annular seal, the seal delivery assembly comprising a piston axially movable relative to the stem and adapted to drive the energizing ring to set the annular seal in the annulus when the stem engagement element is engaged with the stem and a sufficient pressure is applied to the piston via the axial passage in the stem, wherein the stem will not travel a sufficient distance to enable the stem engagement element to engage the stem at the second position unless the annular seal travels the desired axial distance relative to the inner wellhead member.

7. The running tool of claim 6, wherein the stem engagement element comprises:

a plurality of stem locking dogs biased radially inward and into engagement with the stem by a plurality of resilient members; and wherein the cam is positioned between the stem locking dogs and the body in the first position to prevent movement of the stem locking dogs radially outward, and thus enables engagement of the stem locking dogs with the stem.

8. The running tool of claim 7, wherein the stem engagement assembly is configured so that the cam is translated axially from a position between the stem locking dogs and the body to enable the stem locking dogs to move radially outward, disengaging the stem locking dogs from the stem, by rotating the stem a given amount of rotation.

9. The running tool of claim 8, wherein the stem and the stem engagement assembly are configured so that the cam is translated axially to a position between the stem locking dogs and the body to urge the stem locking dogs to move radially inward, engaging the stem locking dogs with the stem, by rotating the stem a given amount of rotation.

10. The running to tool of claim 6, wherein the stem further comprises:

a first contoured surface located in an outer diameter for engagement with the stem locking dogs in the run-in position; and a second contoured surface located in the outer diameter for engagement with the stem locking dogs in the landing position, the second contoured surface being positioned a select distance above the first contoured surface.

11. The running to tool of claim 6, wherein the running tool further comprises a piston cap connected to and surrounding the stem such that piston cap and the stem rotate and translate in unison; and a piston engagement element carried by piston cap and capable of movement between a first position when the running tool is in a run-in position and a second position when the running tool is in a set position, the engagement element being engaged with the piston in the set position to allow weight to be transferred from the stem and to the piston when testing the annular seal.

12. A method of setting and testing an annular seal having an energizing ring in an annulus between an inner wellhead member and an outer wellhead member of a well, the method comprising:

(a) providing a running tool with an elongated stem having an axial passage; a body substantially surrounding and connected to the stem; a cam positioned between and connected to the body and the stem such that rotation of the stem causes the cam to translate axially relative to the body; a stem engagement element initially engaged with the stem and maintained in engagement with the stem by the cam; and a piston, substantially surrounding portions of the stem and the body and downwardly moveable relative to the stem;

(b) running the tool into a subsea wellhead;

(c) rotating the stem relative to the body to a delivery position, thereby removing the support of the cam and disengaging the engaging element from the stem;

(d) moving the stem axially downward relative to the body to land the annular seal;

(e) if the annular seal is delivered to a desired location in the annulus relative to the inner wellhead member, reengaging the engaging element with the stem in a landing position; and (f) applying fluid pressure to the axial passage, thereby driving the energizing ring to set the annular seal in the annulus, thereby moving the running tool to a set position, if the annual seal was delivered to the desired location in step (e).

13. The method of claim 12, wherein the stem engagement element will not engage the stem unless the annular seal is located at a desired location in the annulus relative to the inner wellhead member, thereby allowing the stem to move freely relative to the body if the annular seal is not in the desired location, thus preventing the piston from driving the energizing ring to set the annular seal in the annulus.

14. The method of claim 12, the method further comprising after step (a), but before step (b):

rotating the stem relative to the body to a run-in position, thereby securely engaging the running tool with the inner wellhead member.

15. The method of claim 12, wherein the stem further comprises:

a first contoured surface located in an outer diameter; and a second contoured surface located in the outer diameter, the second contoured surface being positioned a select distance above the first contoured surface; and wherein in step (a):

the engagement element is in engagement with the first contoured surface; and wherein in step (e):

if the annular seal is delivered to a desired location in the annulus relative to the inner wellhead member, the engagement element is in engagement with the second contoured surface.

16. The method of claim 12, wherein:

step (a) further comprises providing the running tool with an upper stem port located in and extending radially through the stem and an upper body port located in and extending radially through the body;

step (e) further comprises aligning the upper stem port and the upper body port with each other and with a piston chamber if the annular seal is delivered to a desired location in the annulus relative to the inner wellhead member; and step (f) further comprises causing the fluid in the axial passage to flow through the upper stem port and through the upper body port into the piston chamber, thereby driving the energizing ring to set the annular seal in the annulus if the annual seal was delivered to the desired location in step (e).

17. The method of claim 16, wherein:

step (a) further comprises providing the running tool with a lower stem port located in and extending radially through the stem and a lower body port located in and extending radially through the body; and wherein the lower stem port and the lower body port are not aligned while in the set position.

18. The method of claim. 16, wherein:

step (a) further comprises providing the running tool with a piston engagement element connected to the stem and engaged with the piston in a first engaged position; and wherein step (f) further comprises:

moving the piston engagement element from a first engaged position to a second engaged position, thereby allowing weight applied to the stem to be transferred to the piston if the annual seal was delivered to the desired location in step (e).

19. The method of claim 12, wherein:

step (a) further comprises providing the running tool with a lower stem port located in and extending radially through the stem and a lower body port located in and extending radially through the body;

after step (f), rotating the stem relative to the body to a test position, thereby aligning the lower stem port and the lower body port; and applying fluid to the axial passage, thereby causing the fluid to flow through the lower stem port and through the lower body port, thereby testing the annular seal.

20. The method of claim 19, wherein:

step (a) further comprises providing the running tool with an upper stem port located in and extending radially through the stem and an upper body port located in and extending radially through the body; and wherein the upper body port and the upper stem port are aligned while in the seal test position.

21. The method of claim 19, wherein movement from the set position to the test position is accomplished by rotating the stem in the same direction relative to the body as in step (c).

22. The method of claim 19, wherein the cam moves axially upward relative to the body when the stem is rotated from the set position to the test position.

23. The method of claim 19, wherein the method further comprises:

rotating the stem relative to the body from the test position to a release position, thereby releasing the running tool from the inner wellhead member.

* * * * *